United States Patent [19]

Aspin

[11] 4,091,607

[45] May 30, 1978

[54] TWINE AND METHOD OF FORMING SAME

[75] Inventor: Anthony Frank Aspin, Knutsford, England

[73] Assignees: Aspin Shaw, Ltd.; Francis Shaw & Co. Ltd.; Pakord Ltd., all of Great Britain

[21] Appl. No.: 707,657

[22] Filed: July 22, 1976

[30] Foreign Application Priority Data

Jul. 29, 1975 United Kingdom ..... 31591/75

[51] Int. Cl.[2] ..... D02G 3/06; B29D 7/14

[52] U.S. Cl. ..... 57/140 R; 57/157 R; 264/DIG. 47

[58] Field of Search ..... 57/157 R, 157 TS, 155, 57/167, 140 R, 34 R; 428/43, 399, 400; 28/DIG. 1; 225/3, 97; 264/DIG. 8, DIG. 47

[56] References Cited

U.S. PATENT DOCUMENTS

| | | | |
|---|---|---|---|
| 3,164,947 | 1/1965 | Gaston | 57/140 J |
| 3,470,285 | 9/1969 | Kim et al. | 264/DIG. 47 |
| 3,470,685 | 10/1969 | Hall et al. | 264/DIG. 47 |
| 3,494,522 | 2/1970 | Kim et al. | 264/DIG. 47 |
| 3,801,252 | 4/1974 | Waterhouse | 28/DIG. 1 X |
| 3,851,034 | 11/1974 | Harmon et al. | 264/DIG. 47 |
| 3,864,198 | 2/1975 | Jackson | 57/157 TS X |
| 3,884,030 | 5/1975 | Baxter et al. | 57/167 X |
| 3,906,073 | 9/1975 | Kim et al. | 28/DIG. 1 |
| 3,922,329 | 11/1975 | Kim et al. | 264/210 R X |
| 3,981,952 | 9/1976 | Ruddell et al. | 264/DIG. 47 X |

FOREIGN PATENT DOCUMENTS

| | | | |
|---|---|---|---|
| 1,349,249 | 4/1974 | United Kingdom | 264/DIG. 47 |

*Primary Examiner*—Donald Watkins
*Attorney, Agent, or Firm*—Stuart J. Friedman

[57] ABSTRACT

There is disclosed a process for making fibrous material which is particularly suitable for the manufacture of baler twine. The material is preferably made from polypropylene and is produced from film which is roll-embossed and fibrillated, the roll-embossing temperature being substantially lower than the conventional roll-embossing temperature. In the case of polypropylene film this is within the range 60° C to 90° C, preferably about 80° C. As a result, the fibrous material has a high proportion of clusters of from 2 to 5 unseparated incipient filaments. Baler twine made from the material is economical to produce and has improved physical characteristics especially good strength combined with good knot retention ability.

12 Claims, 3 Drawing Figures

TWINE AND METHOD OF FORMING SAME

Figure 1:
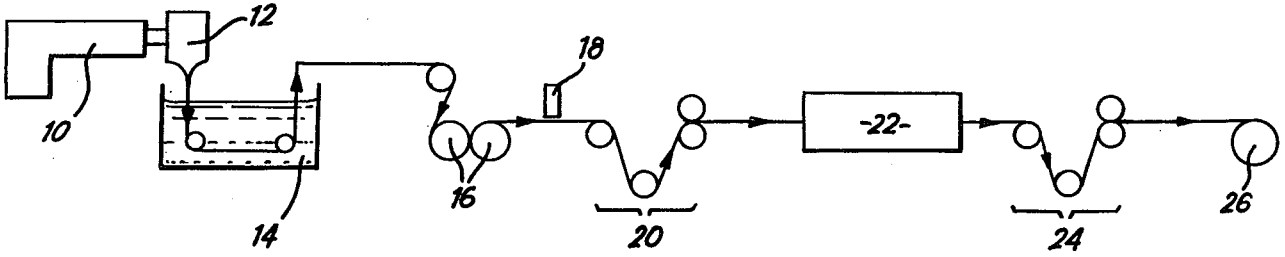

This invention concerns the manufacture of twine and the like.

There has been considerable interest for several years in the production of various types of fibrous materials from molecularly-orientable synthetic thermoplastic semicrystalline organic polymer film (hereinafter called "film of the type described"). Basically, the film is drawn in its lengthwise direction, whereupon it fibrillates, or is readily fibrillatable, and is used, after fibrillation to a greater or lesser degree, to make non-woven fabrics, twine, yarn and so on. In some processes the film is embossed to provide a plurality of parallel longitudinal portions of reduced dimensions to encourage, on fibrillation, the formation of discrete continuous filaments.

The general object of the present invention is to enable a fibrous strand to be made from film of the type described, which has, for certain end uses, very good characteristics.

One particular object of the invention is to provide reasonably priced baler twine having an improved combination of physical characteristics. For many years much baler twine was made from sisal, a natural material, and involving the usual lengthy processing to extract from the sisal plant, fibres suitable for making the twine. More recently baler twine has been made from polypropylene film of the type described. In each case the film has been drawn fibrillated and twisted. In one case fibrillation (e.g. pin fibrillation) is not continued beyond the stage where the film is reduced to a largely interconnected network: the resulting twine is not very strong though its knot retention characteristics are reasonable. In another case the film is embossed whilst hot to form a plurality of parallel longitudinal enlarged portions connected by alternate, relatively fragile, parallel longitudinal portions. By subsequent drawing and fibrillation the enlarged portions are separated from each other to form, as it were, a plurality of single filaments which are then twisted together. The resulting twine has satisfactory tensile strength but its knot retention characteristics are poor. Sometimes these known baler twines have been unable to compete, so far as cost is concerned, with sisal baler twine.

According to one broad aspect of the invention, a process for making fibrous material from film of the type described, which includes the steps of embossing the film whilst hot to form a plurality of parallel longitudinal enlarged portions connected by alternate, relatively fragile, parallel longitudinal portions, drawing the film, and fibrillating it, is characterised in that the temperature of the film during embossing is substantially lower than that which would conventionally be employed, but not so low as to give rise to brittleness of the film and consequent mechanical fracture under processing stresses.

The film is preferably largely or wholly of polypropylene, in which case the temperature may be within the range 60° C to 90° C, desirably within the range 80° C to 90° C, and preferably about 80° C which is at least 20° C lower than the conventional embossing temperature.

Such a process gives rise to surprising results. On manipulating the processed film, it has been found that there is fibrillation and that fibrous material results. However it was discovered that the fibrillation was of a limited extent in that the enlarged portions had not all been separated one from the other, but that there were a substantial number of "clusters" present containing various numbers of enlarged portions still connected together. Using a conventional embossing roller having say 20 grooves per cm. on polypropylene film of thickness about 0.20 mm., with the film temperature during embossing at about 80° C we found a tendency for clusters containing from 2 to 5 "filaments" to form, as well as individual filaments. Whilst the preferred temperature was 80° C we found the tendency to be present to some useful extent using temperatures from 60° C to 90° C. When the fibrous material was twisted (fibrillation may be caused simply by twisting) into, for example, a baler twine, we found that the twine had a surprising combination of characteristics, namely high strength and excellent knot retention and efficiency. Since the cost of the product was also acceptably low, it is admirably suited for use as tying material, whether hand or machine knotted.

According to a further aspect of the invention therefore, fibrous material, for making baler twine, made from film of the type described, comprises, whether or not single continuous filaments are present, a substantial proportion of clusters containing from 2 to 5 unseparated incipient filaments which have been formed by embossing the film. These clusters preferably form 90% or more of the material.

Whilst the factors governing the manner in which the clusters are formed may not be fully understood, it is possible to control to some extent, at least, the nature of the clusters. Thus by appropriately varying the dimensions of every third land between the embossing roller grooves we can, for example, obtain a great preponderance of clusters of three. In this way some characteristics of the end product can be governed.

As to other processing variables, it is preferred that the roll embossing pressure should be of the same order as in conventional roller embossed film lines; and the same applies to the stretch ratio and stretching oven temperature. The film thickness should preferably be not less than 60% of the groove depth.

As to the twist of the twine this will depend for one thing on the final denier required. The invention is principally concerned with deniers of from about 3,000 to 50,000 and the smaller the denier, the greater the twist. The range is approximately 25 to 40 turns per meter. For 25,000, for example, a twist of about 32 turns per meter is preferred. It is most convenient to slit the material to the final denier prior to drawing. However, it has been found that for high deniers this sometimes gives rise to an undesirable degree of transverse molecular orientation. In this case the film should be slit to narrower widths and two or more used to form the final twine.

These preferred criteria all apply to polypropylene film, or film containing at least 90% by volume of polypropylene.

Figure 2:
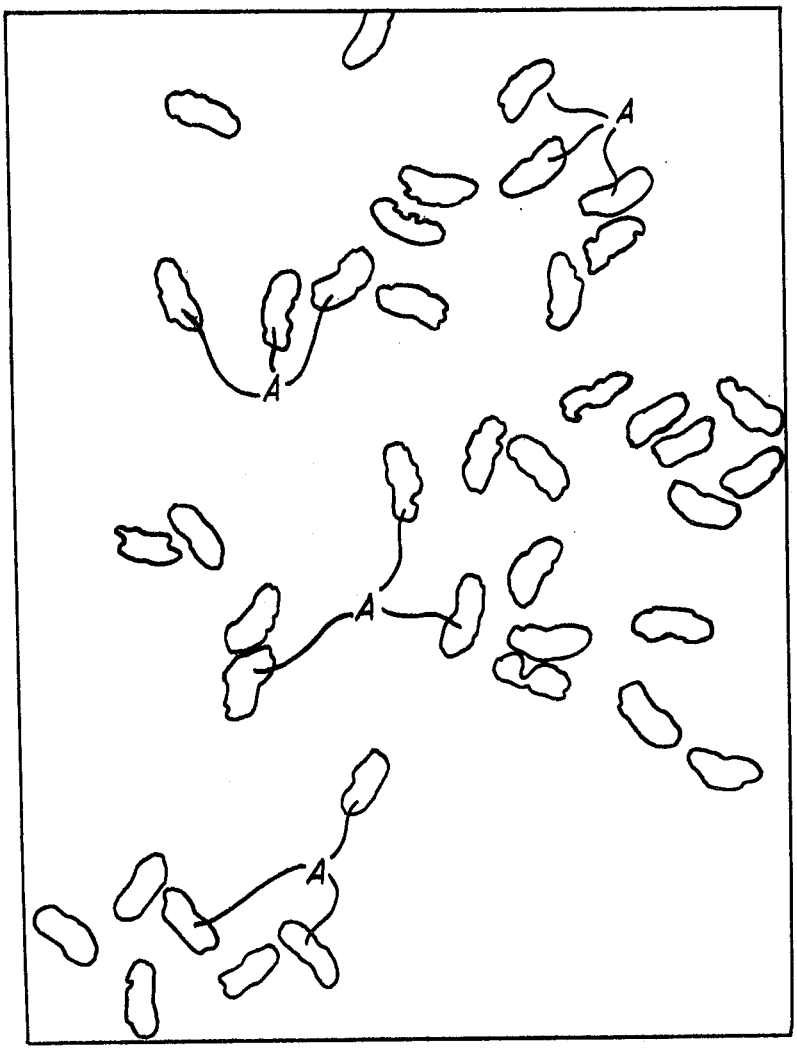
Figure 3:
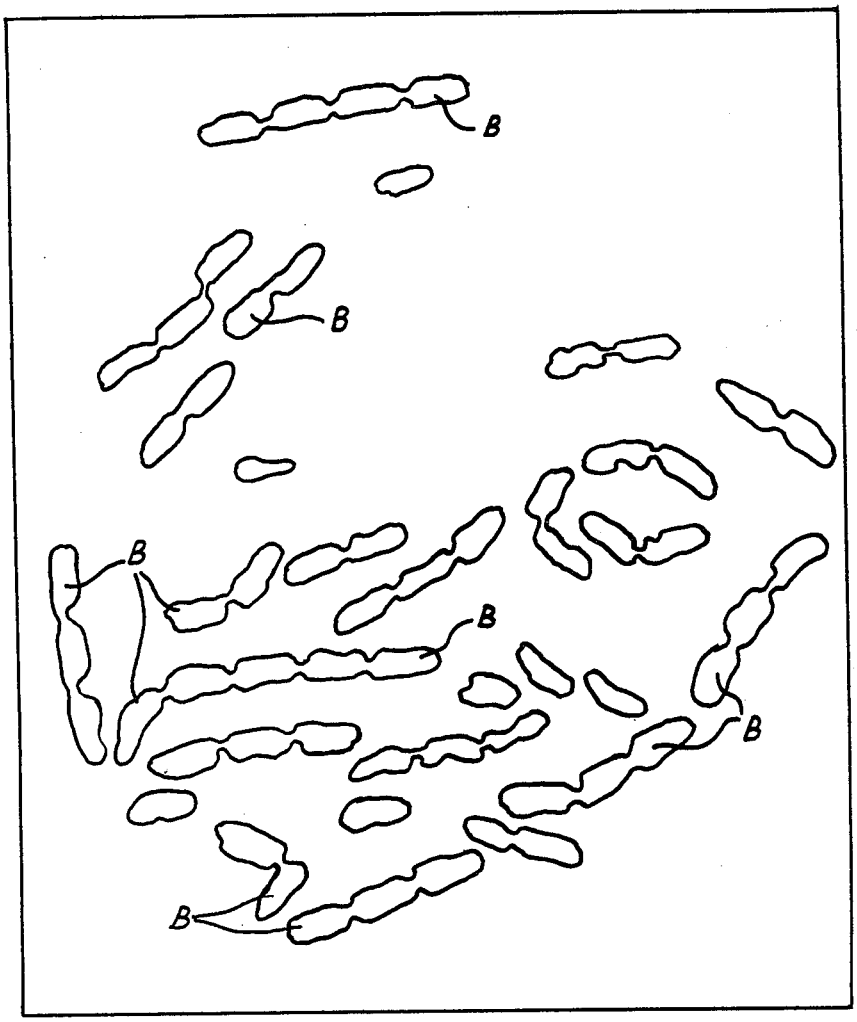

The invention will now be described further in connection with the production of baler twine, by examples, and with reference to the accompanying drawings, in which, FIG. 1 is a diagram illustrating a machinery line for carrying out the process of the invention;

FIG. 2 is a partial cross-sectional magnified view of a conventional baler twine made from embossed film of the type described, and FIG. 3 is a partial cross-sectional magnified view of a baler twine according to the invention.

Referring first to FIG. 1 the machinery line consists of, in succession, an extruder 10 fitted with a film-forming die 12, a water quench bath 14 an REF (roller embossed film) unit 16, slitting means 18, first godet rolls 20, a hot air oven 22, second godet rolls 24, and a winder 26. The path of the film is indicated by the arrowed line.

Twisting is preferably carried out as a separate operation, for example on a ring-twister.

There now follow two examples of how the machinery may be used to produce material from which baler twine is then made.

EXAMPLE I

The barrel of extruder 10 was 85 mm diameter, with a 25:1 length to diameter ratio. The slot of die 12 was 600 mm long, the lip separation being 0.635 mm. An Aspin REF unit 16 was used, the embossing roll being 50 cm wide with approximately 19 grooves per cm, the included groove angle being 55°. Such units may be obtained from the firm Aspin Shaw Limited, of Manchester, England.

Tbe film material was Shell CARLONA polypropylene grade KY61. The three regions of the extruder barrel were at 178° C, 190° C and 210° C respectively, whilst the die adaptor was maintained at 230°, as was the die. An extruder screw speed of 43 r.p.m. was selected. The extruded film thickness was 0.21 mm. As to the REF unit the embossing roll was at 83° C; the nip pressure was 170 kg per cm of nip width; and the embossing speed 10 m per minute. The stretch ratio between the godet rolls 20, 24 was 10:1 and the stretching oven temperature 200° C.

The stretched embossed film, slit by slitter 18 into four tows each of approximately 20,000 denier, was wound up. On later twisting on a ring twister at approximately 40 turns per meter, which caused, or completed, the fibrillation of the film, a baler twine resulted having a tenacity of 5.2 gms per denier, and a baler type thumb knot efficiency of 58.4% (i.e. the tensile stress to break at the knot was 58.4% of the normal breaking stress of the twine). Knots formed in the twine showed no undesirable tendency whatever to unform.

EXAMPLE II

In this example the only processing changes compared with Example I were that the extruded film thickness was 0.25 mm, the embossing roll temperature 80° C, and the stretching oven temperature 190° C. The tows, consequently, were approximately 25,000 denier each. The resulting baler twine had a tenacity of 4.96 gms per denier and a knot efficiency of 67.0%. This, as in Example I, compared favourably with even substantially higher denier twines produced by conventional fibrillated film methods.

It is to be noted in passing that winding up and twisting appeared, in both Examples to proceed in a rather unexpectedly trouble-free manner.

It will be appreciated that the embossing roll temperatures of 83° C and 80° C are 20° C or more lower than normal embossing roll temperatures.

Reference will now be made to FIGS. 2 and 3 which show, by highly magnified partial cross-section views, a typical conventional baler twine made from roller embossed film and a typical baler twine made according to the invention. In the former it is clear that virtually all the constituent filaments A are "single" whereas, in the latter there is a high proportion of clusters B of 2 to 5 unseparated incipient filaments.

I claim:

1. In a process for making fibrous material from film of the type described which includes the steps of simultaneously heating and embossing the film to form a plurality of parallel longitudinal enlarged portions connected by alternate, relatively fragile, parallel longitudinal portions, and drawing the film to a fibrillatable state, the improvement wherein the temperature of the film during embossing is substantially lower than that which would conventionally be employed, but not so low as to give rise to brittleness of the film and consequent mechanical fracture under processing stresses.

2. In a process for making fibrous material for conversion into tying twine from molecularly-orientable synthetic thermoplastic semi-crystalline organic polymer film including the steps of simultaneously heating and embossing the film to form a plurality of parallel longitudinal enlarged portions connected by alternate, relatively fragile, parallel longitudinal portions and drawing the film to a fibrillatable state, the improvement comprising maintaining the temperature of the film during embossing within the range 60° C to 90° C.

3. A process as claimed in claim 2 in which the temperature of the film during embossing is within the range 80° C to 90° C.

4. A process as claimed in claim 2 in which the temperature of the film during embossing is 80° C.

5. A process as claimed in claim 2 in which a grooved embossing roller is used to emboss the film and in which the thickness of the film is not less than 60% of the depth of the embossing roller grooves.

6. A process as claimed in claim 2 followed by the conversion of said fibrous material into twine by twisting said fibrous material to cause fibrillation to separate at least some of said enlarged portions from each other to leave a substantial proportion of clusters containing from 2 to 5 unseparated parallel longitudinal enlarged portions.

7. A process as claimed in claim 2 wherein said film is at least 90% by volume polypropylene.

8. A process as claimed in claim 6 wherein said clusters comprise at least 90% of said twine.

9. The product made by the process of claim 2.

10. The product made by the process of claim 6.

11. The product made by the process of claim 7.

12. The product made by the process of claim 8.

* * * * *